United States Patent [19]

Hettinger

[11] 4,397,357

[45] Aug. 9, 1983

[54] DISCONNECTABLE PRODUCTION RISER ASSEMBLY

[75] Inventor: Fredric L. Hettinger, Ojai, Calif.

[73] Assignee: Vetco Offshore, Inc., Ventura, Calif.

[21] Appl. No.: 255,972

[22] Filed: Apr. 20, 1981

[51] Int. Cl.[3] ..... E21B 33/035

[52] U.S. Cl. ..... 166/345; 166/346; 166/364; 175/7

[58] Field of Search ..... 166/341-347, 166/350, 357, 359; 175/7; 137/236.05

[56] References Cited

U.S. PATENT DOCUMENTS

| | | | |
|---|---|---|---|
| 3,189,098 | 6/1965 | Haeber | 175/7 X |
| 3,280,908 | 10/1966 | Todd | 166/345 X |
| 3,324,943 | 6/1967 | Price | 166/340 |
| 3,347,312 | 10/1967 | Neilson | 166/359 X |
| 4,169,507 | 10/1979 | Szymczak | 166/340 |

OTHER PUBLICATIONS

"Early Subsea Production System" by B. H. von Bilderbeek, The Apea-Journal, 1977.

*Primary Examiner*—Ernest R. Purser

*Attorney, Agent, or Firm*—Edward L. Kochey, Jr.

[57] ABSTRACT

A production riser assembly for producing oil to a floating platform includes a central riser (22) and a plurality of production risers (34) annularly spaced around the central riser. The central riser has a flexible joint (26) with a hydraulic connector (82) therebelow. Each production riser has a flexible hose (47) at its lower end which is connectable to flowline subs (46) located in spaced relation from the central riser connector. Hydraulically operated connectors (45) are located at the bottom end of each flexible pipe, and each riser is independently tensioned.

5 Claims, 4 Drawing Figures

DISCONNECTABLE PRODUCTION RISER ASSEMBLY

BACKGROUND OF THE INVENTION

This invention relates to oil production to a floating platform, and in particular to a riser assembly for multiple flowlines. In the production of oil from subsea wells, it is required to convey the oil to the surface in order to degasify it before pumping to another location. A riser assembly for this purpose is illustrated in "Early Subsea Production System" by B. H. van Bilderbeek, page 131, the *APEA Journal,* 1977. This includes a central riser as a structural member and a number of peripheral flowline risers annularly spaced around the central riser. The central riser may be used for returning the processed oil to the seabed for transport to a subsea pipeline.

These flowlines are held in spaced relationship around the riser at a plurality of elevations by spiders attached to the central riser. Movement of the floating platform is accommodated by a flexible joint near the bottom of the central riser, and by flexible hoses near the bottom of the flowline risers.

A lower riser package includes the flexible joint and flexible hoses. This package is stabbed on a riser connector which releasably holds the package down and also holds the package on production flowline stab connections. Retrieval of the package or any one of the flexible pipes is accomplished by disconnecting the central riser and withdrawing the entire assembly.

Individual peripheral production risers are stabbed on the upper end of the flexible hose of the riser package with a mechanical lock and hydraulic unlock connector. Each flowline may be withdrawn after disconnecting the connector, but the flexible pipe may not be so withdrawn.

Since the riser assembly may bend in the order of 10 degrees around the flexible joint located at the bottom of the central riser, the flexible hoses must have sufficient slack to take up differential movement caused by this bending. This results in a large and, therefore, relatively small radius expansion loop, with this small radius limiting the use of TFL (through the flowline) tools.

Since the flexible pipes experience much bending, they are the most likely component to require replacement. In this prior art arrangement, it was required to remove the entire riser system and to raise the lower riser package in order to replace even one of these hoses. Not only must the entire system be withdrawn but production through all of the lines must be stopped.

SUMMARY OF THE INVENTION

A central riser carries at its lower end a major locking connector which is connectable to a central riser stub anchored to the seabed. A plurality of production risers are annularly spaced around the central riser and include a flexible pipe at the lower end. A crossover assembly is fastened to the major locking connector and includes flowline crossover subs, and a frame spacing these subs from the major connector. A pin for a hydraulically actuated connector is located at the lower end of each of the flexible pipes for selective connection to the flowline crossover subs. Each of the production risers and the central riser is independently tensioned.

With the hydraulic release connector pin at the bottom end of the flexible pipe, any one of the production risers may be independently released and removed without disturbing the other risers. A single flexible pipe can, therefore, be replaced. A running tool of limited flexibility may stiffen the hose when running the production riser in, thus providing sufficient guidance to pass through the various spider funnels and to meet the lower connection. This running tool would be removed after the connection has been made.

Each line is individually tensioned thereby precluding the need for the large expansion bend with its small radius. Accordingly, TFL tools may be run through the production riser systems.

DESCRIPTION OF THE PREFERRED EMBODIMENT

Figure 1:
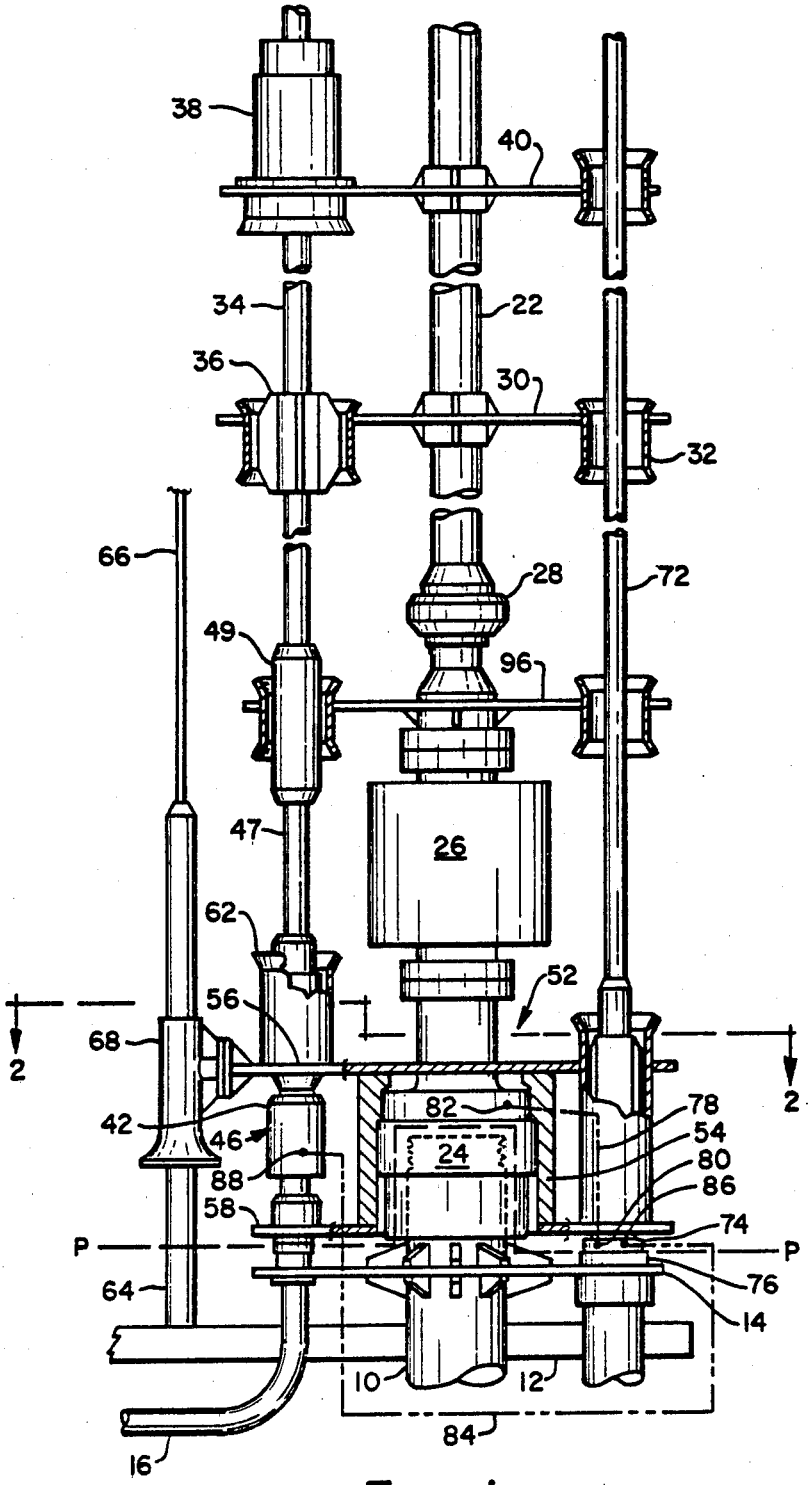
FIG. 1 illustrates a sectional general arrangement of the production riser system.

A central riser stub 10 is securely fastened to the seabed and is installed in a permanent template 12 which includes base plate 14. Flowlines 16 which normally come from other producing wells are fastened at a preselected location to the base plate 14, with a vertical flowline stub 18 extending upwardly. The central riser stub 10 has at its upper end a male member of a coupling with locking grooves 20 thereon. A central riser 22 terminates at its lower end in a locking connector 24 which is a female member including hydraulically actuated locking dogs which lock into and are released from the grooves 20 in response to hydraulic pressure. This locking connection is termed a major locking connector to differentiate it from the minor connectors which are discussed hereinafter.

This central riser may be used for conveying oil processed at the surface to a subsea pipeline or may be only a structural member. Closely spaced above the major locking connector is a flexible joint 26 which permits a 10 degree angular movement of the central riser. The riser is formed of 15 meter sections of pipe joined by riser connectors 28. At preselected elevations the riser also carries spiders 30 which maintain guide funnels 32 annularly spaced around the central riser. The central riser is maintained in tension from the floating platform preferably by the use of a motion compensating riser tensioning apparatus.

A plurality of flowline production risers 34 annularly surround the central riser and are maintained in spaced relationship from the riser by means of centralizer sleeves 36 at elevations corresponding to the guide funnels 32.

The production flowlines are preferably tensioned by flowline tensioners 38 which are mounted on a support platform 40 which is in turn supported with the central riser 22. With such an arrangement the flowline tensioner need only have sufficient travel to compensate for differences between the effective length of the production riser and the central riser caused by bending of the system around the flexible joint 26. Cables are connected to a number of full travel riser tensioners which support the load of the central riser 32. The production riser may, of course, be alternately tensioned by an independent riser tensioner for each of the flowlines 34.

Each production riser 34 is terminated at its lower end by a minor locking connector pin 42. This pin is locked to a locking connector box 44 which incorporates hydraulically actuated locking dogs 43 therein at the upper end of a flowline crossover sub 46. When latched, this connector cannot be released by pulling on the flowline, but the flowline may be parted at this location by hydraulically retracting the dogs and withdrawing the flowline. All pressure seals are preferably in the flowline connector pin 42 since this portion of the connector may be more readily released and withdrawn to the surface for any required maintenance work.

Locking connector pin 42 and locking connector box 44 together comprise the minor locking connector 45. Either minor connector half, i.e., the pin or the box, may be on the riser 34, with the other half being on the crossover sub 46. It is the remote latching and unlatching capability of the minor connector which is significant.

The lower portion of each production riser 34 is formed of a length of flexible pipe 47. Such pipe is in the nature of armoured tubing, and a typical type is "Coflexip" as illustrated on page 1702 of the 1978–1979 *Composite Catalogue of Oil Field Equipment,* published by World Oil. This pipe permits bending of the production risers, when bending occurs around the central riser flexible joint 26. Bending of this pipe will be with sufficient radius to permit the passing of TFL equipment.

Each production riser 34 may be individually withdrawn, including the flexible pipe portion. Replacement of the flexing member may, therefore, be made without shutting down or retrieving the entire production riser assembly.

The lowest centralizer 49 of each production riser may be a coupling joining the flexible pipe and the conventional hard pipe. This centralizer is also longer than the upper centralizers 36.

The lower end of the crossover sub 46 is adapted to slidably fit over the flowline stub 18 and carries within it seals 50. These seals are preferably located within the crossover sub since that sub may be more readily withdrawn to the surface than the end of the flowline 16. The flowline crossover sub 46 is held down against the flowline sub 18 against upward forces by crossover assembly 52 which is described in detail below.

The crossover assembly 52 is comprised of a plurality of components which are fastened to and spaced from the major locking connector 24. It follows that locking of the major connector secures all the components of the crossover assembly in place, while unlatching the locking connector permits withdrawal of all of these components.

A locking connector housing 54 is secured to the major locking connector 24 and carries at its upper end a horizontal plate 56 and at its lower end a horizontal plate 58. Wing plates 60 are welded between the upper and lower plates to increase the stiffness and rigidity of the crossover assembly.

The flowline crossover sub 46 is bolted or welded to lower plate 58 so that it may be carried therewith, and this is a portion of the crossover assembly. Also, a lower guide funnel 62 is secured to the upper plate 56. This funnel serves to guide the production flowline, when an individual line is to be run and reconnected.

It can, thus, be seen that with the apparatus as described so far, each of the production flowlines 34 may be individually disconnected as desired for maintenance purposes by actuation of the minor locking connectors 44. Should, however, there be an emergency need to completely disconnect the entire production riser system, the major locking connector 24 can be disconnected and the riser assembly lifted. The system will part along parting line P—P of FIG. 1, with the central riser parting in the locking connector and with the production riser lines parting at the lower sliding connection. Loss of hydraulic power to the flowline safety valves as described hereinafter causes the flowlines automatically to close off.

The system described is a guideline system wherein guide posts 64 are also carried on the permanent template 12. Guidelines 66 extend upwardly to the floating platform.

As part of the crossover assembly 52, there is included guide cones 68 which are rigidly fastened to either the upper plate 56 or the lower plate 58 of the frame, thereby maintaining the guide cones in fixed spaced relationship from the major locking connector 24. In addition to the normal function of the guide cones of guiding the assembly to the appropriate connections, an additional function is carried out in this apparatus. When the central riser is being run and carrying with it the crossover assembly 52, each flowline connection sealingly slides over the flowline stubs 18. Should binding occur on certain of the flowline stubs, there would be a tendency for the crossover assembly to cock and possibly bind. The guide cones aid in resisting the cocking of the crossover assembly.

Figure 2:
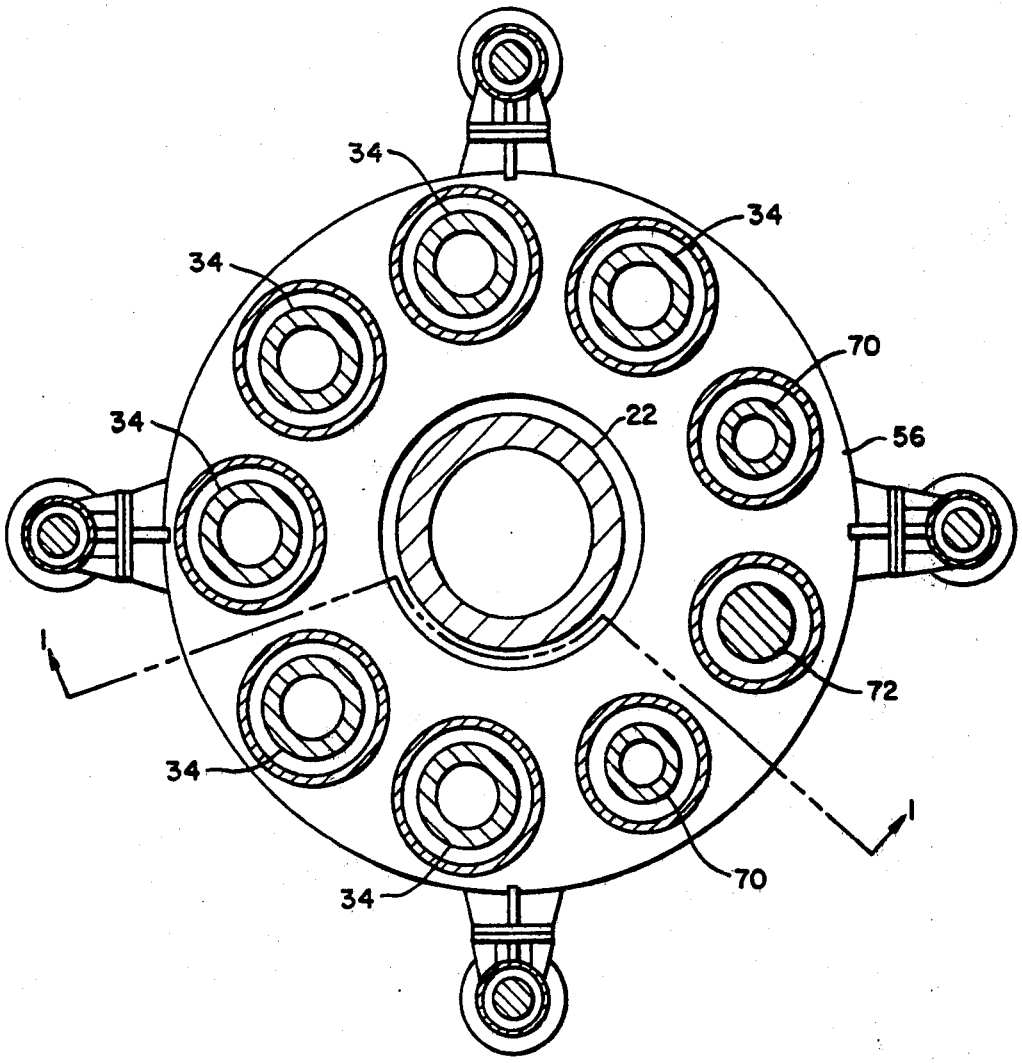
FIG. 2 is a plan view taken through section 2—2 of FIG. 1.
Figure 3:
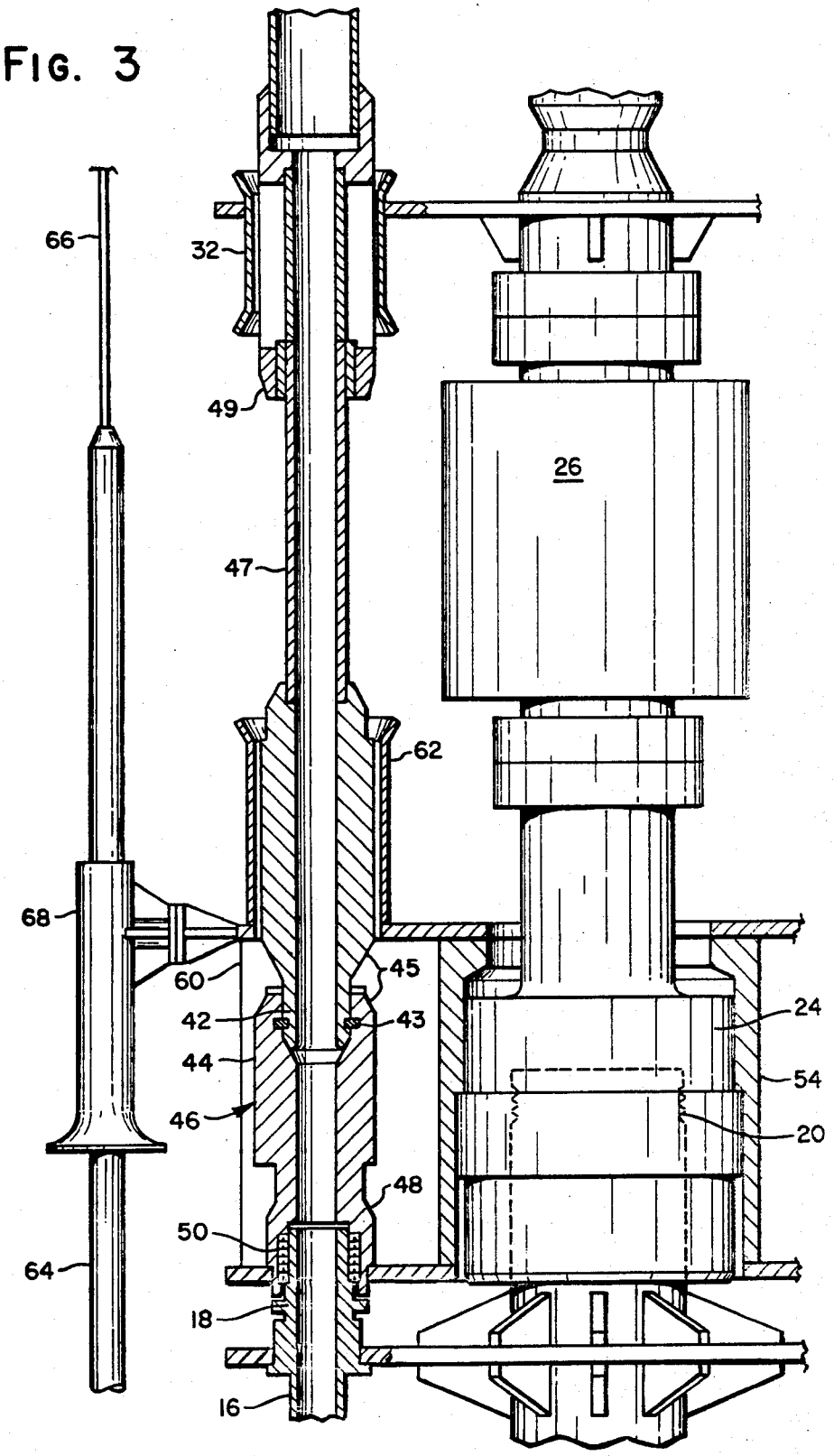
FIG. 3 is a sectional view through the area of a flowline crossover sub.

As can be seen in FIG. 2, the illustrated system includes six production flowlines 34 and two injection/service lines 70. These injection/service lines may include a minor locking connector 44 if it is desired to retain the ability to disconnect these lines individually, or they may depend entirely on a sliding connection such as that at the lower end of the flowline crossover assembly.

Also included and held in spaced relationship with the central riser is a hydraulic control umbilical line 72. In the illustrated embodiment it is assumed that there is no desire to independently release the umbilical line and, accordingly, no lockable connection is included. The line rather continues with the lower end of a control pod 74 adapted to fit within and mate with a control pod receptacle 76. This lower end 74 of the umbilical line also forms a portion of the crossover assembly and is firmly attached thereto such that locking of the major locking connector locks the umbilical line into the receptacle 76. Appropriately located connections located between the control pod and the receptacle permit hydraulic fluid to be conveyed and controlled through various control lines to operate various valves in the permanently installed subsea piping. Safety valves may be located in each of the flowlines so that in the event of a disconnect at the receptacle, hydraulic pressure is lost with the safety valve automatically closing and thereby preventing flow of oil out of the flowlines.

Hydraulic control to the locking connectors 24 and 44 is preferably accomplished by hard lined piping between the umbilical line 72 and the various connectors. Control line 78 is piped between connection 80 of the umbilical line and connection 82 of the major locking connector. It can be seen that both of these components form a portion of the crossover assembly and, therefore, move together. Hydraulic control of the major connector is, therefore, obtainable at all times.

Control line 84 is hard piped between connection 86 at the bottom of the umbilical line and connection 88 on the flowline crossover sub 46. It is thereafter internally ported through the locking connector 44 to operate the dogs located therein. Hydraulic pressure is required to lock and unlock the connection.

In running the production assembly the central riser 22 is lowered carrying spiders 30 and the crossover assembly 52. The hydraulic control pod 74 is also carried with the crossover assembly. The flowline crossover sub 46 is run as a part of the crossover assembly. The guide cones 68 sliding over the guide posts 64 orient the assembly, and a stab is made with the central riser connector 24 over central riser stub 10 and by the flowline subs 46 over the flowline stubs 18. The hydraulic control pod 74 slides into receptacle 76. Hydraulic control of the dogs in the major locking connector 24 is effected through control line 78, thereby locking the crossover assembly in place.

The production risers 34 may now be lowered through the guide funnels and stabbed over the upper end of the flowline crossover sub with the minor locking connector pins locking in the locking connector 44 of the crossover sub.

In the event of an emergency condition requiring disconnecting all of the risers, the major locking connector 24 is unlatched and the entire assembly raised with the separation occurring on the parting line P—P. The flexible pipe 47 is subject to repeated bending and is, therefore, the component most likely requiring replacement. With the inventive arrangement, an individual flexible pipe may be replaced without disturbing the central riser or the other production risers. The hydraulically actuated dogs 43 of the appropriate minor locking connector 44 are withdrawn. The selected production riser along with its flexible pipe may then be withdrawn.

Figure 4:
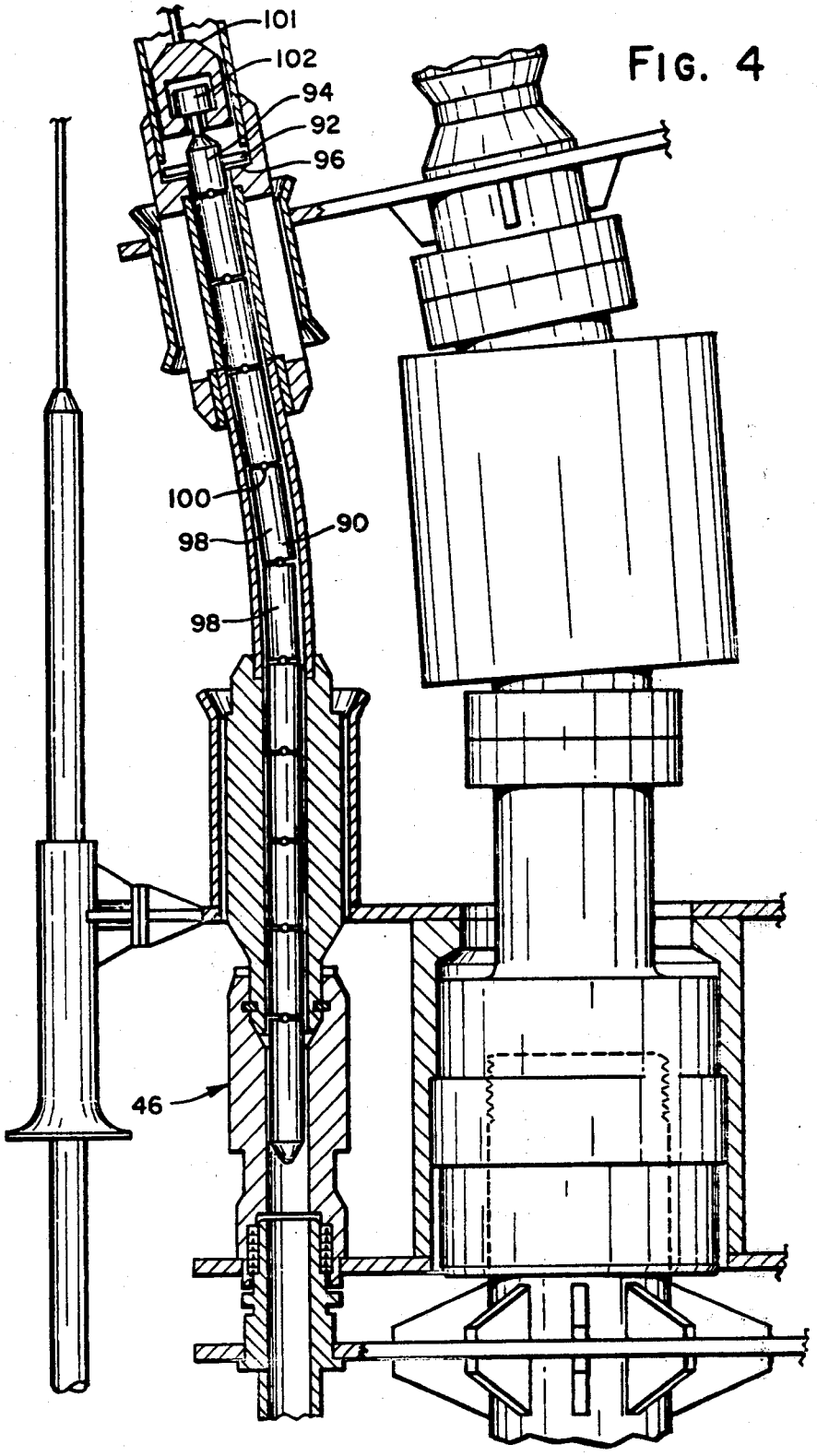
FIG. 4 is similar to FIG. 3 at a 10 degree deviation and with a flowline running tool inserted.

When the production riser 34 is to be run, a running tool 90, illustrated in FIG. 4, may be placed within the flexible pipe portion of the riser. Dogs 92, located in head 94, latch within slots 96 to support the tool. The tool is essentially an elongated rod of limited flexibility, and operates to stiffen the flexible pipe while the riser is being run. The flexible pipe must be held sufficiently straight to engage the succeeding funnels as the line is run, and must permit sufficient forced bending to allow alignment of the connector when the entire system is bending around the flexible joint 26 of the central riser.

The illustrated tool is formed of a plurality of rigid cylindrical sections 98, each attached to adjacent sections by a limited motion universal joint 100. A semi-rigid rod of a plastic material could alternately be used. The lowest centralizer 49 is of sufficient length to fully contact both ends of the guide funnel 32 regardless of the angle of bend of flexible joint 26. This ensures axial alignment of the descending riser so that the size funnel 62 which will intercept the riser may be reliably determined.

After the connector 44 is latched, the running tool is withdrawn using a conventional wireline retrieving tool 101. The retrieving tool will engage a hook 102. An upward pull on this hook will release dogs 92, permitting the running tool 90 to be retrieved.

With the remotely actuated connector 44 located below the flexible hose, the upper end of the hose is free to move vertically with respect to the central riser 22. A large (and, therefore, short radius) expansion loop is not required, thereby permitting the TFL tools, which require a 1.5 meter minimum radius, to pass therethrough. It is also possible to trip a flexible hose of a single production riser for replacement without removing or stopping production of the other risers.

What is claimed is:

1. A production riser assembly for a production of oil to a floating platform comprising: a central riser; a major locking connector fastened to the lower end of said central riser; a plurality of production risers annularly surrounding said central riser; a flexible pipe forming the lower portion of each of said production risers; a base plate anchored to the seabed; a vertically oriented central riser stub fastened to said base plate and adapted to lock with said major locking connector; a plurality of vertically oriented flowline stubs fastened to said base plate and annularly spaced around said central riser stub; a plurality of hydraulically actuated minor connectors; a crossover assembly comprising, said major locking connector, a plurality of flowline crossover subs adapted to slidably seal with corresponding flowline stubs at their lower end and having half of each minor connector at its upper end, and a frame securely holding said crossover subs in spaced relation with said major locking connector; and the other half of each of said minor connectors located at the lower ends of said flexible pipes.

2. An apparatus as in claim 1 having also: means for individually tensioning each of said production risers and said central riser.

3. An apparatus as in claim 1 wherein said crossover assembly also comprises: a plurality of production riser lower guide funnels, held in spaced relationship with said major locking connector in axial alignment with said flowline crossover subs.

4. An apparatus as in claim 3 wherein: said central riser has an angularly flexible joint therein located closely above said major locking connector; additional guide funnels located above said flexible joint and secured in spaced relationship with said central riser at a plurality of elevations, and axially aligned with said production riser lower guide funnels.

5. A production riser assembly for a production of oil to a floating platform comprising: a central riser; a major locking connector fastened to the lower end of said central riser; a plurality of production risers annularly surrounding said central riser; a flexible pipe forming the lower portion of each of said production risers; a base plate anchored to the seabed; a vertically oriented central riser stub fastened to said base plate and adapted to lock with said major locking connector; a plurality of vertically oriented flowline stubs fastened to said base plate and annularly spaced around said central riser stub; a plurality of hydraulically actuated minor connectors; a crossover assembly comprising, said major locking connector, a plurality of flowline crossover subs adapted to slidably seal with corresponding flowline stubs at their lower end and having half of each minor connector at its upper end, and a frame securely holding said crossover subs in spaced relation with said major locking connector; the other half of each of said minor connectors located at the lower ends of said flexible pipes; an elongated tubular running tool of limited flexibility; means for supporting said running tool within said flexible pipe; and means for releasing and retrieving said running tool after a corresponding production riser is secured.

* * * * *